US011320232B1

(12) United States Patent
Chu et al.

(10) Patent No.: US 11,320,232 B1
(45) Date of Patent: May 3, 2022

(54) COLLAPSIBLE PEDAL STRUCTURE OF CROSSBOW

(71) Applicant: Man Kung Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/238,325

(22) Filed: Apr. 23, 2021

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 4,587,944 | A * | 5/1986 | Barnett | F41B 5/12 124/25 |
| 8,161,956 | B2 * | 4/2012 | Bednar | F41B 5/123 124/25 |
| 9,310,153 | B2 * | 4/2016 | Nettleton | F41B 5/1453 |
| 9,982,960 | B2 * | 5/2018 | Trpkovski | F41C 23/14 |
| 10,794,658 | B2 * | 10/2020 | Walthert | F41B 5/12 |
| 2014/0283805 | A1 * | 9/2014 | Dunlop | F41B 5/1403 124/25 |

* cited by examiner

*Primary Examiner* — John A Ricci
(74) *Attorney, Agent, or Firm* — Karin L. Williams; Alan D. Kamrath; Mayer & Williams PC

(57) ABSTRACT

A collapsible pedal structure of a crossbow is mounted on the crossbow, the crossbow includes a bowstring and a string pulling direction, and the collapsible pedal structure contains a pedal, a connection member, and a fastener. The pedal includes a stepping portion and a first coupling seat. The connection member includes a second coupling seat configured to rotatably connect the connection member with the first coupling seat of the pedal so that the pedal rotates in a first direction and a second direction. The fastener includes an aperture configured to receive a defining rod, a releasing means, and a fastening means. The fastening means is configured to fix the pedal in the first direction and the second direction, and the releasing means is configured to release the fastening means.

15 Claims, 17 Drawing Sheets

COLLAPSIBLE PEDAL STRUCTURE OF CROSSBOW

BACKGROUND OF THE INVENTION

Field of the Invention

The present invention relates to a crossbow, and more particularly to a collapsible pedal structure of a crossbow.

Description of the Prior Art

A conventional crossbow contains a body, a limb, a stock formed on a rear end of the body, and a trigger assembly located ahead of the stock. The limb is curved and is disposed adjacent to a front end of the body and intersects with the body to form a cross shape, and a bowstring is defined between two ends of the limb. Furthermore, the conventional crossbow contains a pedal mounted on a front end of the crossbow and formed on a frame shape. In use, a user's foot inserts into and steps the crossbow so as to pull the bowstring backward completely to engage with the trigger assembly, and the limb is driven by the bowstring to deform curvedly, then an arrow is put on the body, abuts against the bowstring, and the user aims a target and triggers the trigger assembly so that the bowstring removes from the trigger assembly, and the limb moves backward because a pulling force of the bowstring disappears, such that the bowstring actuates the arrow on the body to shoot quickly.

However, the pedal is merely used to contact against a ground so that the user's foot inserts and steps the crossbow, then the bowstring is pulled by the user, thus limiting usage. Furthermore, the pedal is fixed and cannot be collapsible, thus causing inconvenient carrying and storage.

The present invention has arisen to mitigate and/or obviate the afore-described disadvantages.

SUMMARY OF THE INVENTION

The primary object of the present invention is to provide a collapsible pedal structure of a crossbow which contains a pedal rotated adjustably forward based on using requirements so that a user's foot inserts and steps the crossbow, and the bowstring is tighten.

Another object of the present invention is to provide a collapsible pedal structure of a crossbow which contains the pedal rotated downward so as to be as a support bipod of the crossbow when shooting, and the pedal is rotated backward to be portable and storable easily.

To obtain above-mentioned aspect, a collapsible pedal structure of a crossbow provided by the present invention is mounted on the crossbow, and the crossbow includes a bowstring and a string pulling direction, and the collapsible pedal structure contains: a pedal, a connection member, and a fastener.

The pedal includes a stepping portion formed on a first side of the pedal, and the pedal includes a first coupling seat formed on a second side of the pedal.

The connection member includes a second coupling seat configured to rotatably connect the connection member with the first coupling seat of the pedal so that the pedal rotates in a first direction and a second direction, and the first direction is opposite to the string pulling direction and corresponds to one of multiple notches, and the second direction is the same as the string pulling direction and corresponds to another of the multiple notches.

The fastener is defined between the pedal and the connection member, the fastener includes an aperture configured to receive a defining rod, a releasing means and a fastening means, the fastening means is configured to fix the pedal in the first direction and the second direction so that the pedal does not rotate, in the meantime, the defining rod is engaged in the one notch, the releasing means is configured to release the fastening means, in the meantime, the defining rod disengages form the one notch so that the pedal rotates along the connection member.

DETAILED DESCRIPTION OF THE PREFERRED EMBODIMENTS

Figure 1:
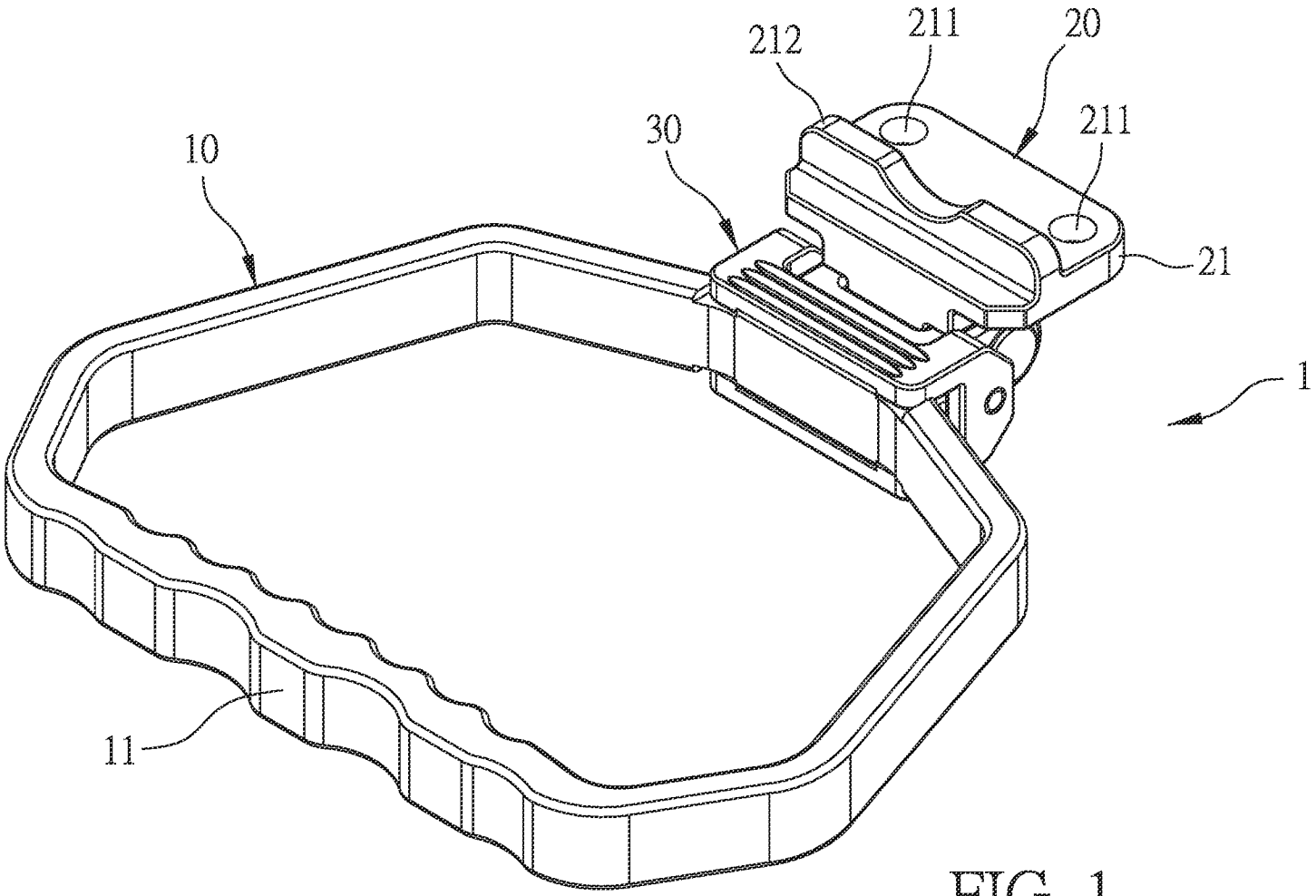
FIG. 1 is a perspective view showing the assembly of a collapsible pedal structure of a crossbow according to a preferred embodiment of the present invention.
Figure 2:
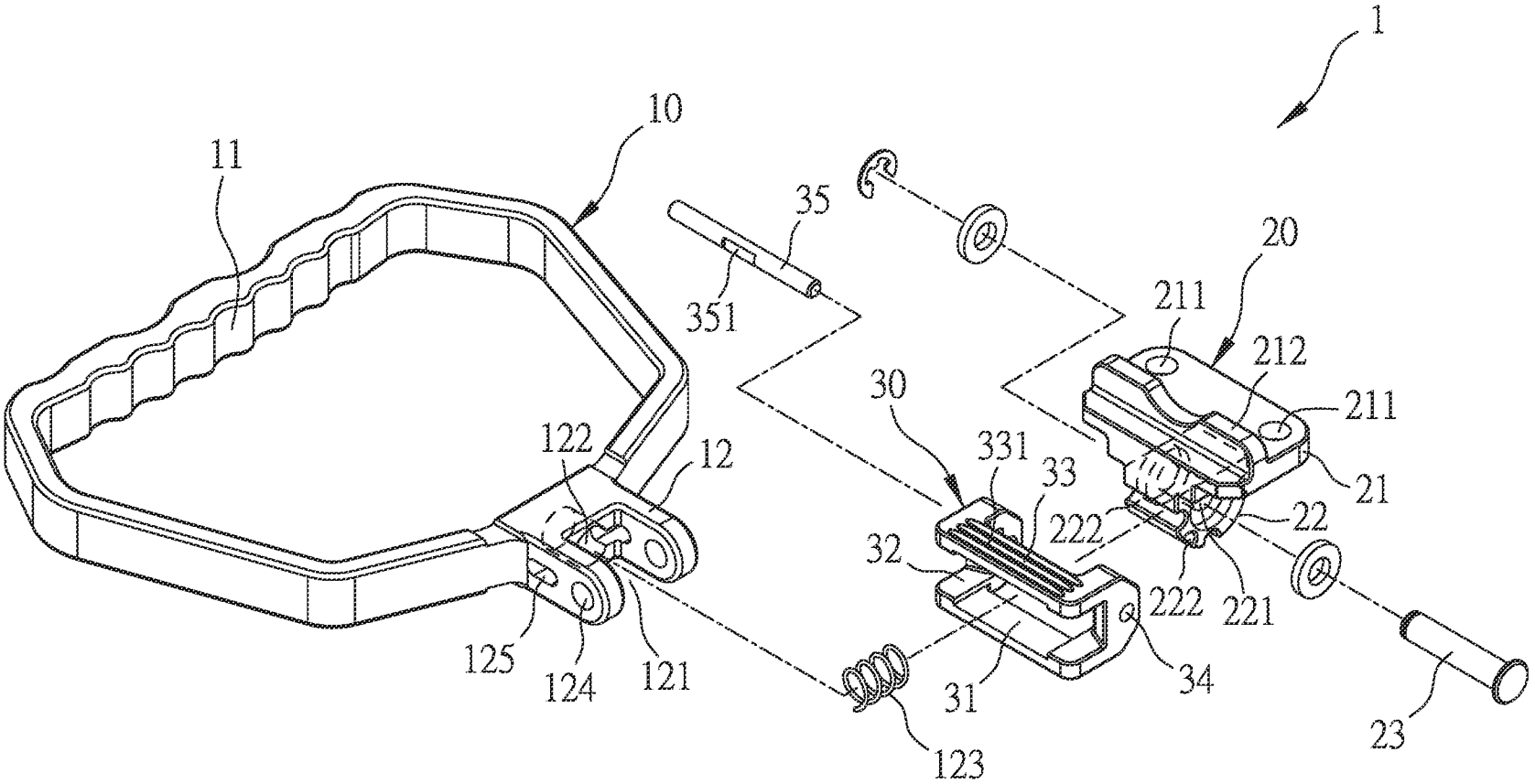
FIG. 2 is a perspective view showing the exploded components of the collapsible pedal structure of the crossbow according to the preferred embodiment of the present invention.
Figure 3:
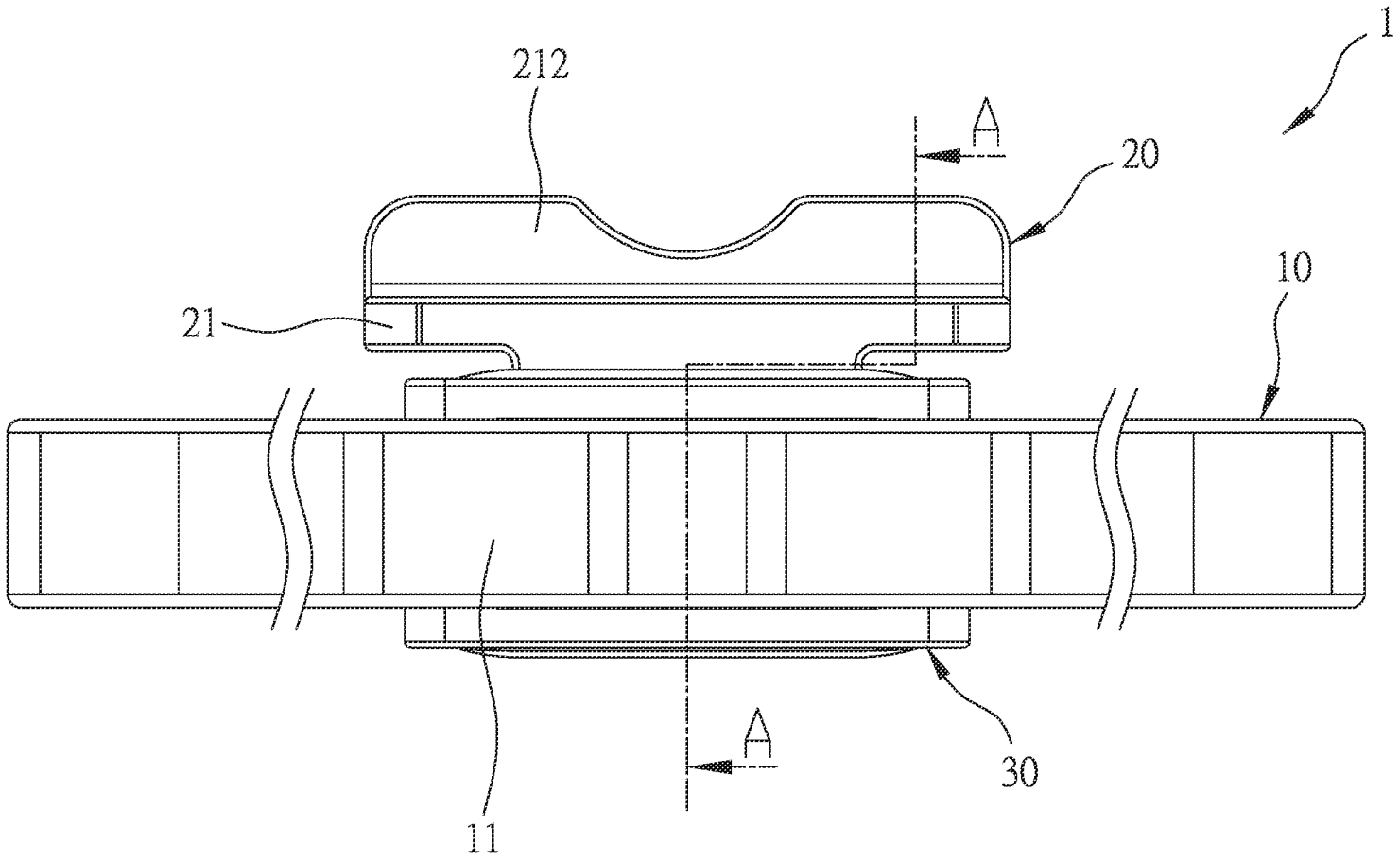
FIG. 3 is a side plan view showing the assembly of the collapsible pedal structure of the crossbow according to the preferred embodiment of the present invention.
Figure 4:
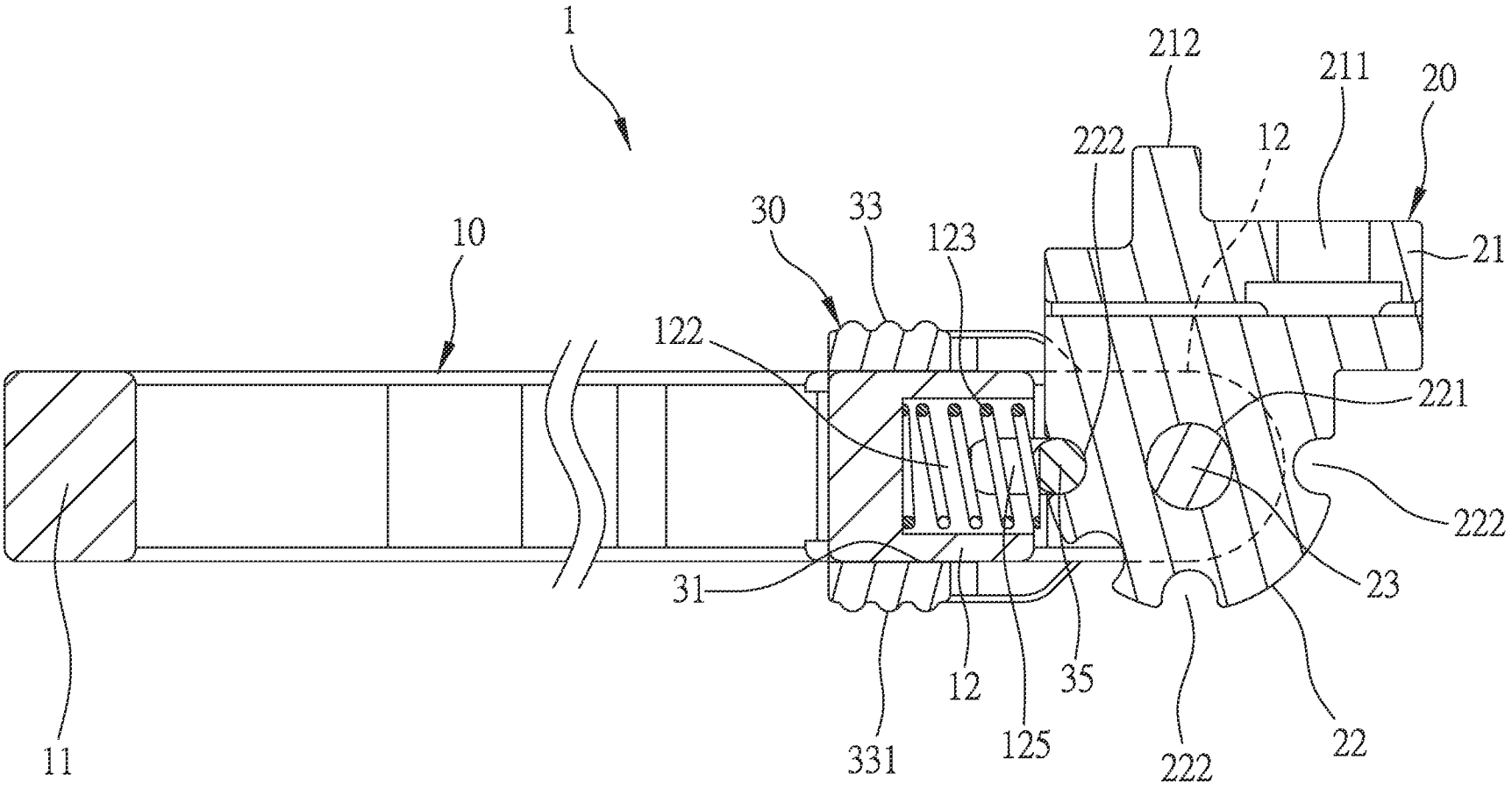
FIG. 4 is a cross sectional view taken along the line A-A of FIG. 3.
Figure 5:
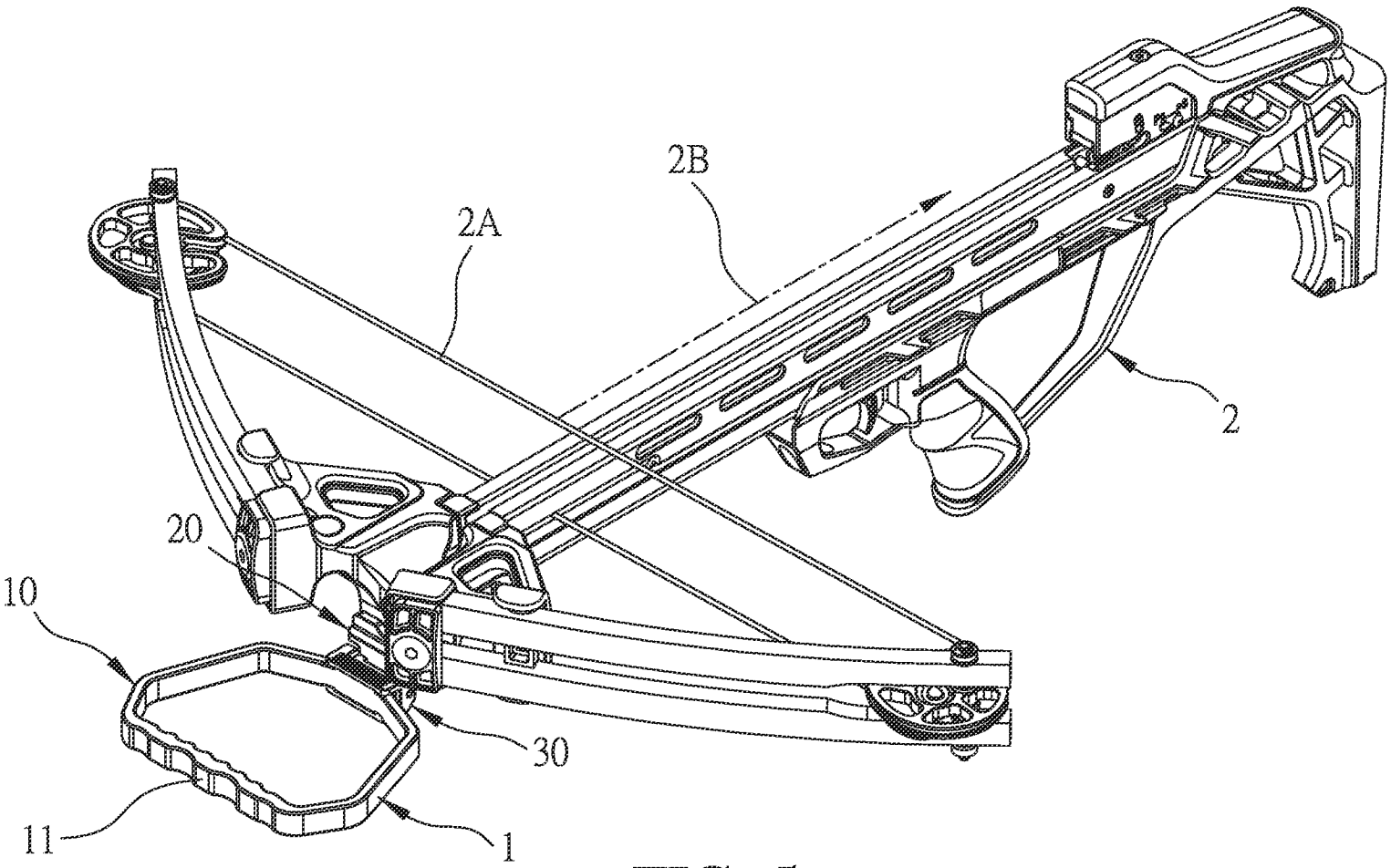
FIG. 5 is a perspective view showing the operation of the collapsible pedal structure of the crossbow according to the preferred embodiment of the present invention.
Figure 6:
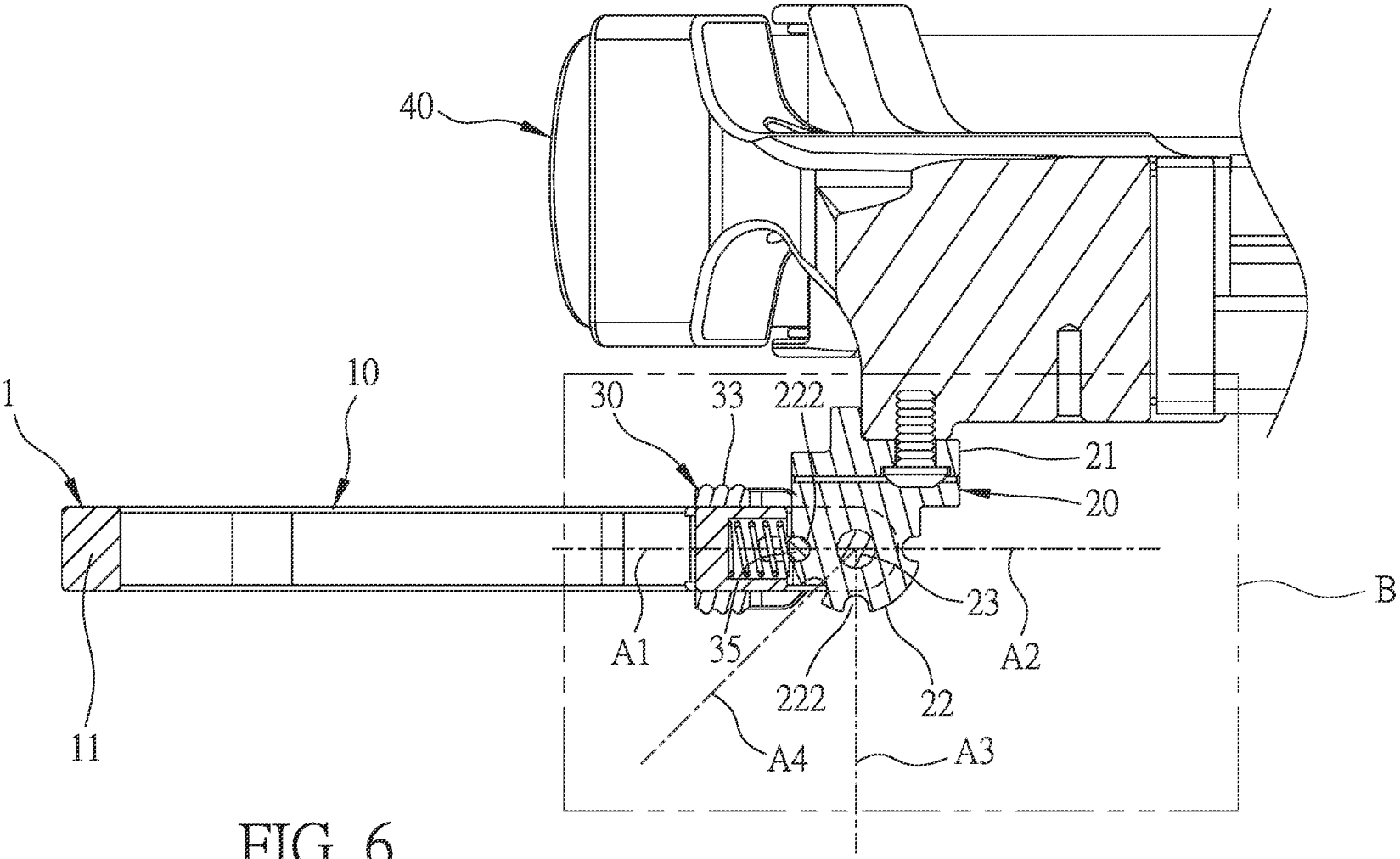
FIG. 6 is a cross sectional view showing the operation of the collapsible pedal structure of the crossbow according to the preferred embodiment of the present invention.
Figure 7:
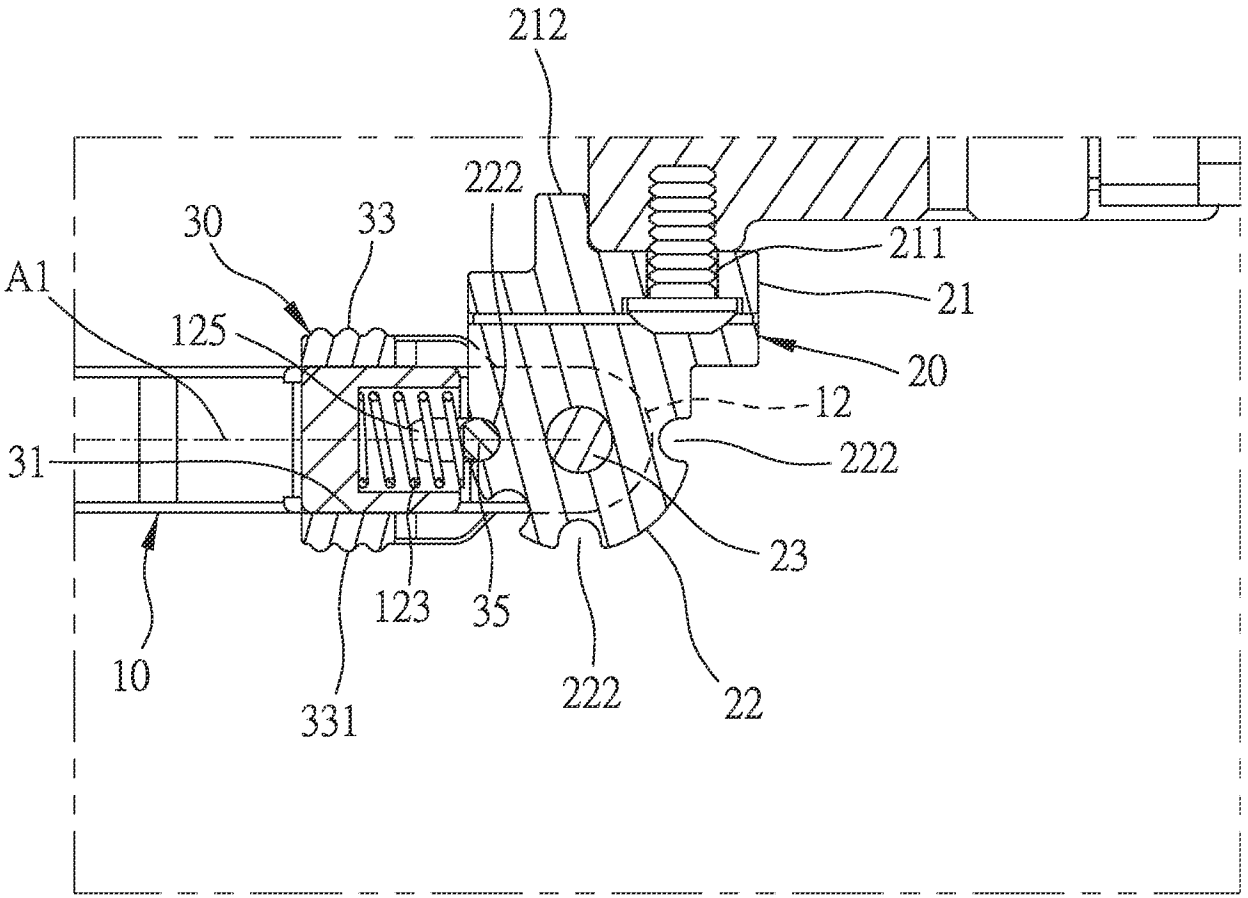
FIG. 7 is an amplified view of a portion B of FIG. 6.

The present invention will be clearer from the following description when viewed together with the accompanying drawings, which show, for purpose of illustrations only, a preferred embodiment in accordance with the present invention.

With reference to FIGS. 1-7, a collapsible pedal structure 1 of a crossbow 2 according to a preferred embodiment of the present invention is mounted on the crossbow 2, the crossbow 2 comprises a bowstring 2A and a string pulling direction 2B, and the collapsible pedal structure 1 includes a pedal 10, a connection member 20, and a fastener 30.

The pedal 10 is formed on a frame shape, and the pedal 10 includes a stepping portion 11 formed on a first side thereof, a first coupling seat 12 formed on a second side of the pedal 10, wherein the first coupling seat 12 has a groove 121, a receiving orifice 122 defined on a bottom of the groove 121, a spring 123 accommodated in the receiving orifice 122, a first connection orifice 124 defined away from the receiving orifice 122 and passing through the groove 121, and an elongated orifice 125 formed proximate to the receiving orifice 122 and passing through the groove 121.

The connection member 20 includes a fixing plate 21 and a second coupling seat 22 extending from the fixing plate 21 downward, wherein the fixing plate 21 has multiple locking orifices 211 and a positioning shoulder 212, and the second coupling seat 22 has a second connection orifice 221 and is configured to fit with the groove 121 of the first coupling seat 12, wherein a connection shaft 23 is inserted through the first connection orifice 124 of the first coupling seat 12 and the second connection orifice 221 of the second coupling seat 22 so that the first coupling seat 12 is rotatably connected with the second coupling seat 22, and the pedal 10 rotates in a first direction A1, a second direction A2, a third direction A3, and a fourth direction A4, wherein the first direction A1 is opposite to the string pulling direction 2B, the second direction A2 is the same as the string pulling direction 2B, the third direction A3 is located between the first direction A1 and the second direction A2, and the third direction A3 is perpendicular to the crossbow 2, wherein the fourth direction A4 is located between the first direction A1 and the second direction A2, and the fourth direction A4 leans to the first direction A1, wherein a profile of the second coupling seat 22 is arcuate, the second coupling seat 22 has multiple notches 222 defined on an outer wall thereof in the first direction A1, the second direction A2, the third direction A3, and the fourth direction A4.

The fastener 30 is fixed between the pedal 10 and the connection member 20, and the fastener 30 includes a releasing means and a fastening means, wherein the fastening means is configured to fix the pedal 10 in the first direction A1, the second direction A2, the third direction A3, and the fourth direction A4 so that the pedal 10 does not rotate. The releasing means is configured to release the fastening means so that the pedal 10 rotates along the connection member 20. The fastener 30 includes a sliding orifice 31, a trench 32 defined on a first side thereof, two operation portions 33 formed on a top and a bottom of the fastener 30, and multiple anti-slip ribs 331 arranged on the two operation portions 33, wherein the sliding orifice 31 is fitted on the first coupling seat 12, and the trench 32 shirks the pedal 10. The fastener 30 further includes an aperture 34 passing through the sliding orifice 31, a defining rod 35 passing through the aperture 34 and the elongated orifice 125 of the first coupling seat 12, wherein the defining rod 35 has an abutting plane 351 formed on a middle portion thereof so that the fastener 30 actuates the defining rod 35 to slide in the elongated orifice 125 back and forth, and the fastener 30 actuates the defining rod 35 to slide away from the second coupling seat 22, thus obtaining the releasing means. Furthermore, the fastener 30 actuates the defining rod 35 to slide close to the second coupling seat 22 and to engage in one of the multiple notches 222 of the second coupling seat 22, thus obtaining the fastening means. The fastener 30 is urged by the spring 123 to move toward the second coupling seat 22 so as to engage into the other notch 222 of the second coupling seat 22, thus obtaining the fastening means automatically.

Figure 8:
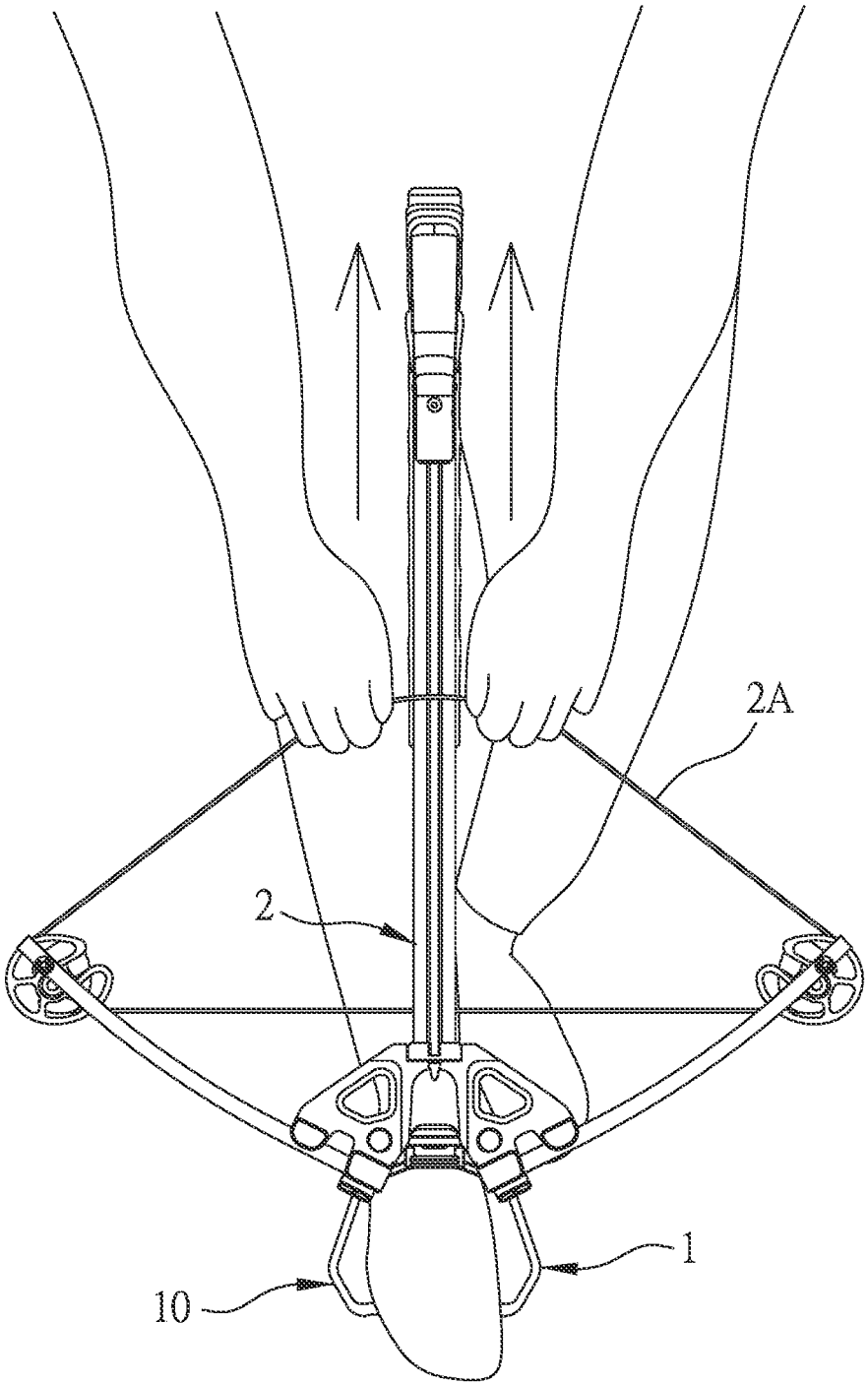
FIG. 8 is another side plane view showing the operation of the collapsible pedal structure of the crossbow according to the preferred embodiment of the present invention.

In use, the fixing plate 21 of the connection member 20 contacts with a bottom of a front end of the crossbow 2, the positioning shoulder 212 of the fixing plate 21 abuts against the front end of the crossbow 2, wherein multiple screwing elements are inserted through the multiple locking orifices 211 of the fixing plate 21 to screw with the bottom of the front end of the crossbow 2. The fastener 30 is controlled by the two operation portions 33 of the fastener 30 to slide toward the stepping portion 11 so that the defining rod 35 disengages from the one notch 222 of the second coupling seat 22, and the pedal 10 is rotated to the first direction A1 (forward), then the fastener 30 is released so that the defining rod 35 is urged by the spring 123 to move toward the groove 121 and to engage into the one notch 222 of the second coupling seat 22 of the connection member 20 so that the pedal 10 is positioned forward. Referring to FIG. 8, the pedal 10 contacts with a ground downward so that a user's foot steps the steeping portion 11 to fix the crossbow 2, such that the bowstring 2A of the crossbow 2 is pulled tightly.

Figure 9:
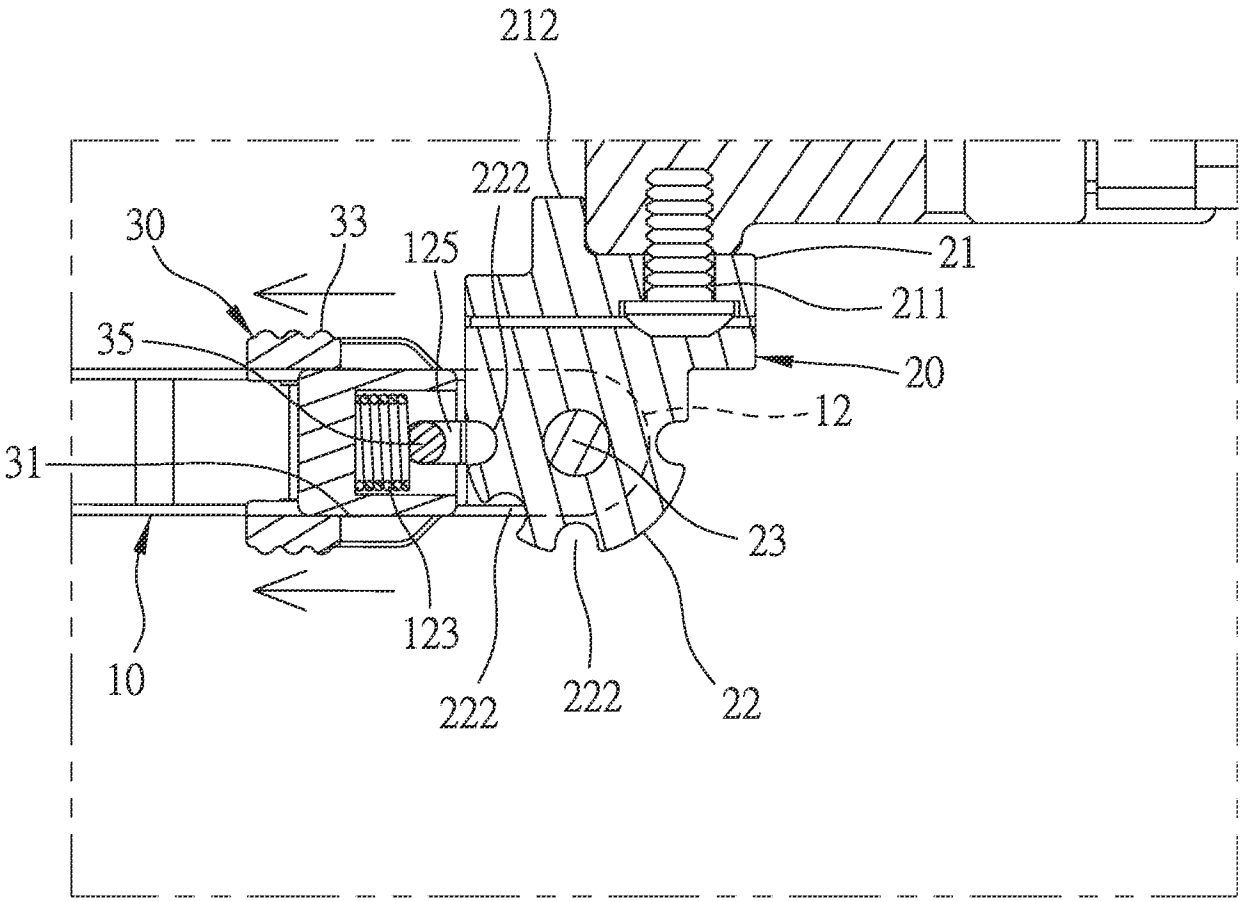
FIG. 9 is another cross sectional view showing the operation of the collapsible pedal structure of the crossbow according to the preferred embodiment of the present invention.
Figure 10:
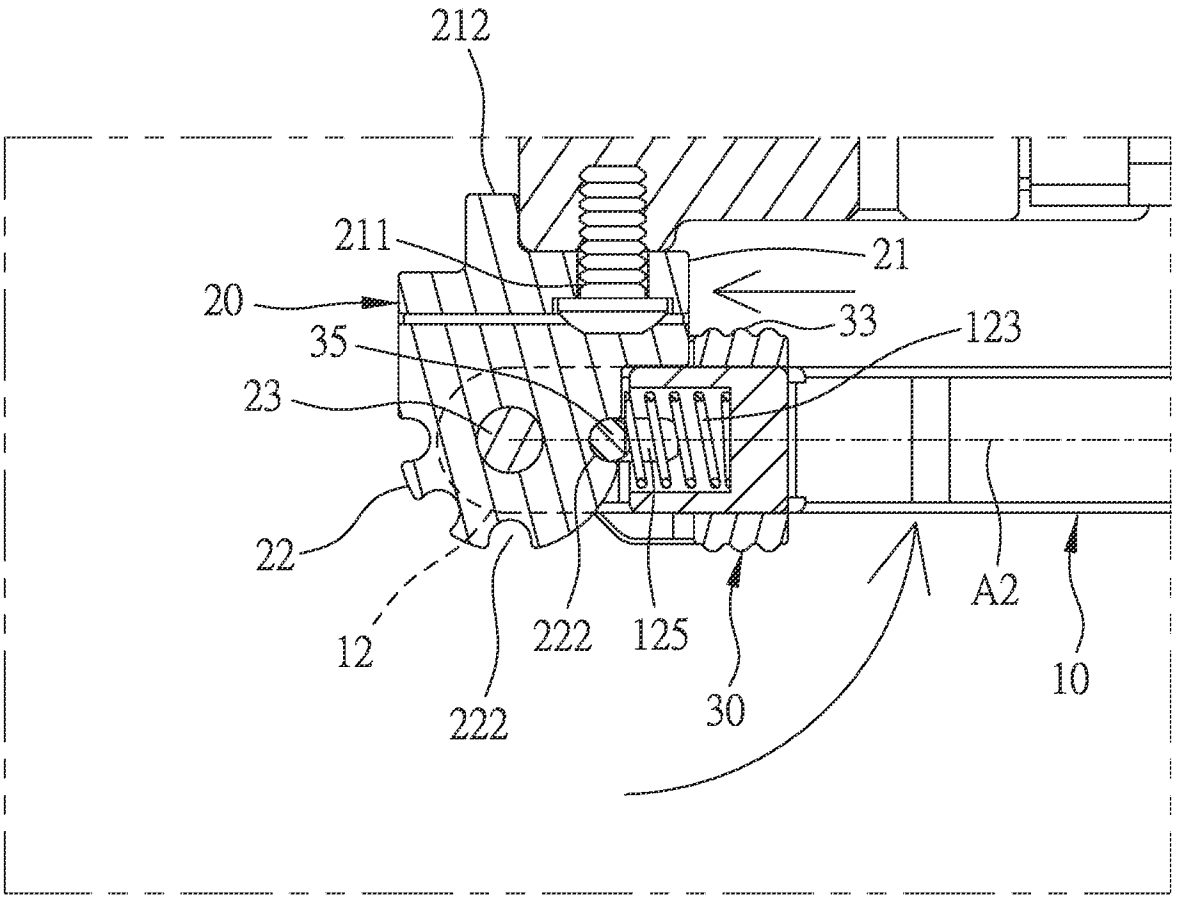
FIG. 10 is also another cross sectional view showing the operation of the collapsible pedal structure of the crossbow according to the preferred embodiment of the present invention.
Figure 11:
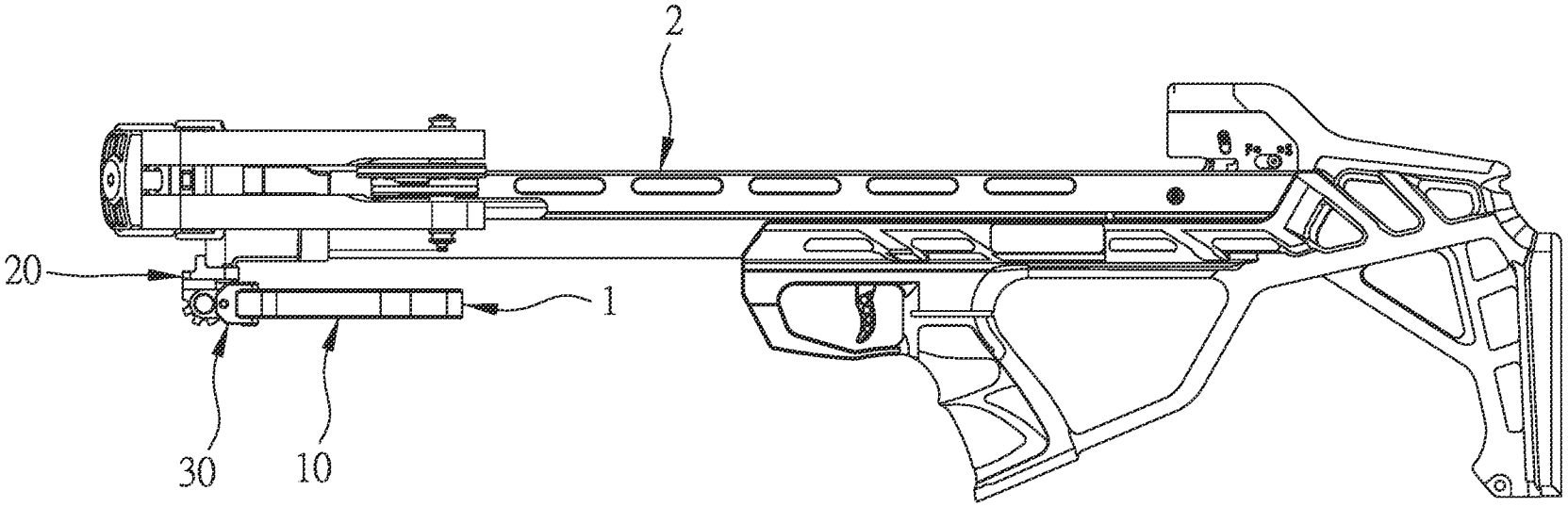
FIG. 11 is also another side plane view showing the operation of the collapsible pedal structure of the crossbow according to the preferred embodiment of the present invention.

As shown in FIGS. 9-11, the two operation portions 33 of the fastener 30 control the fastener 30 to slide toward the steeping portion 11 so that the defining rod 35 disengages from the one notch 222 of the second coupling seat 22 of the connection member 20, and the pedal 10 is rotated toward the second direction A2 (backward), then the fastener 30 is released so that the defining rod 35 is urged by the spring 123 to move toward the groove 121 and to engage into the one notch 222 of the second coupling seat 22 of the connection member 20, and the pedal 10 is positioned backward so as to be accommodated below the crossbow 2, thus reducing storage size of the crossbow 2 and carrying and accommodating the crossbow 2 easily.

Figure 12:
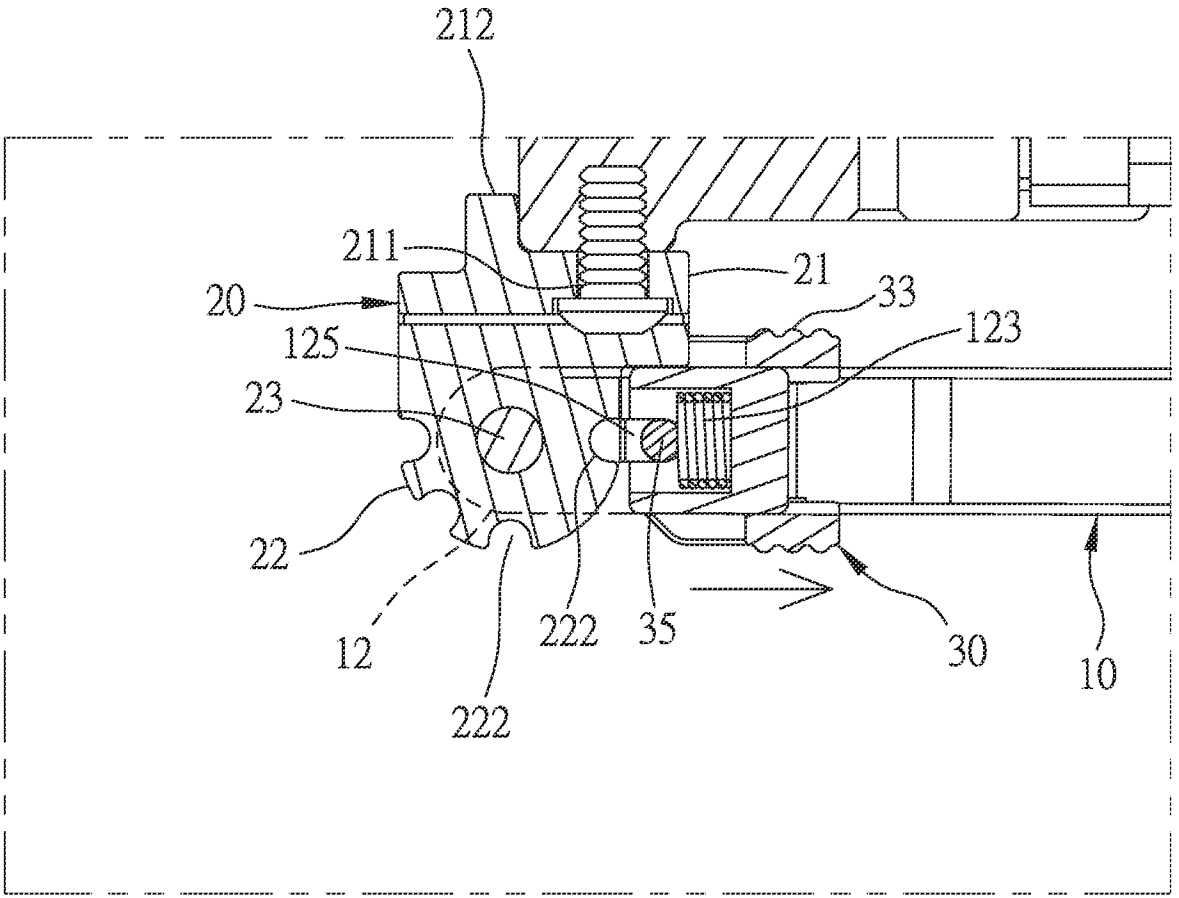
FIG. 12 is still another cross sectional view showing the operation of the collapsible pedal structure of the crossbow according to the preferred embodiment of the present invention.
Figure 13:
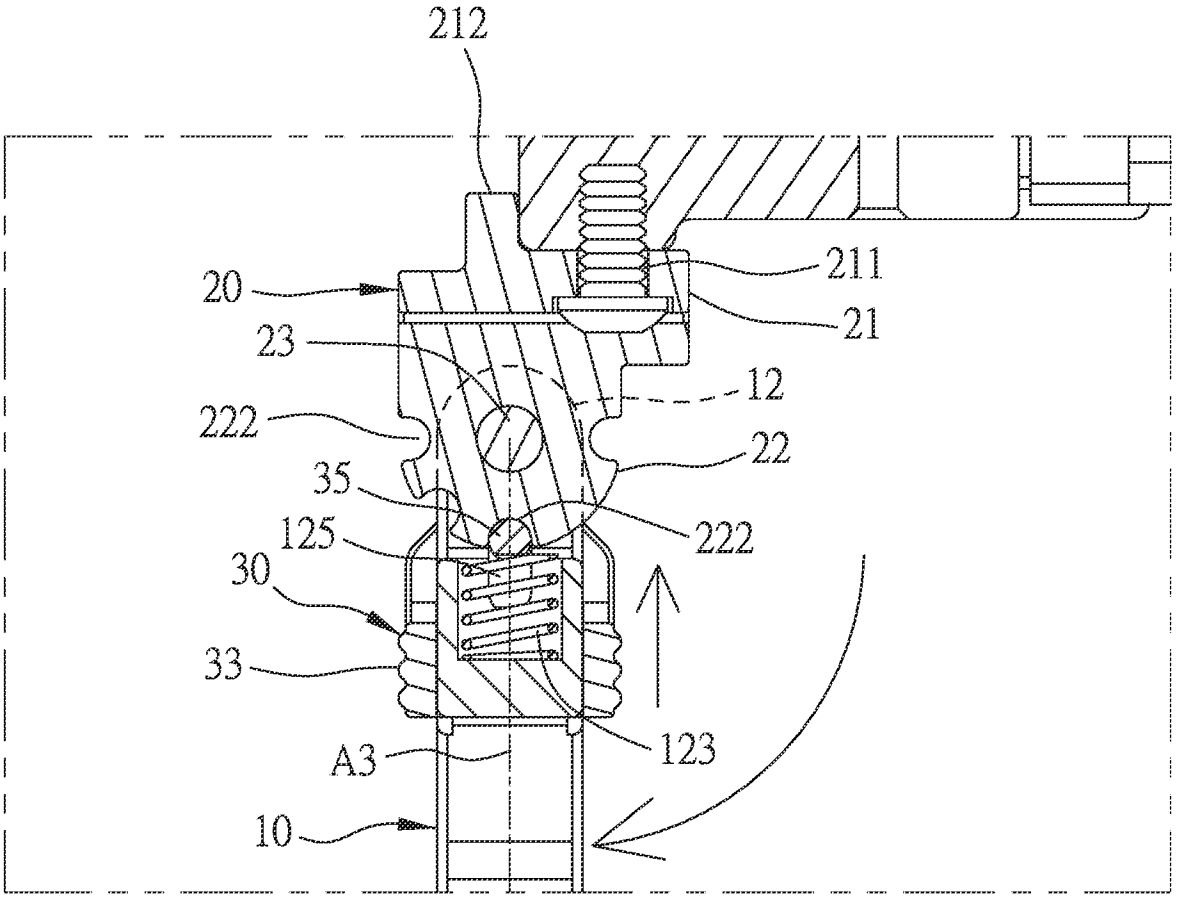
FIG. 13 is another cross sectional view showing the operation of the collapsible pedal structure of the crossbow according to the preferred embodiment of the present invention.
Figure 14:
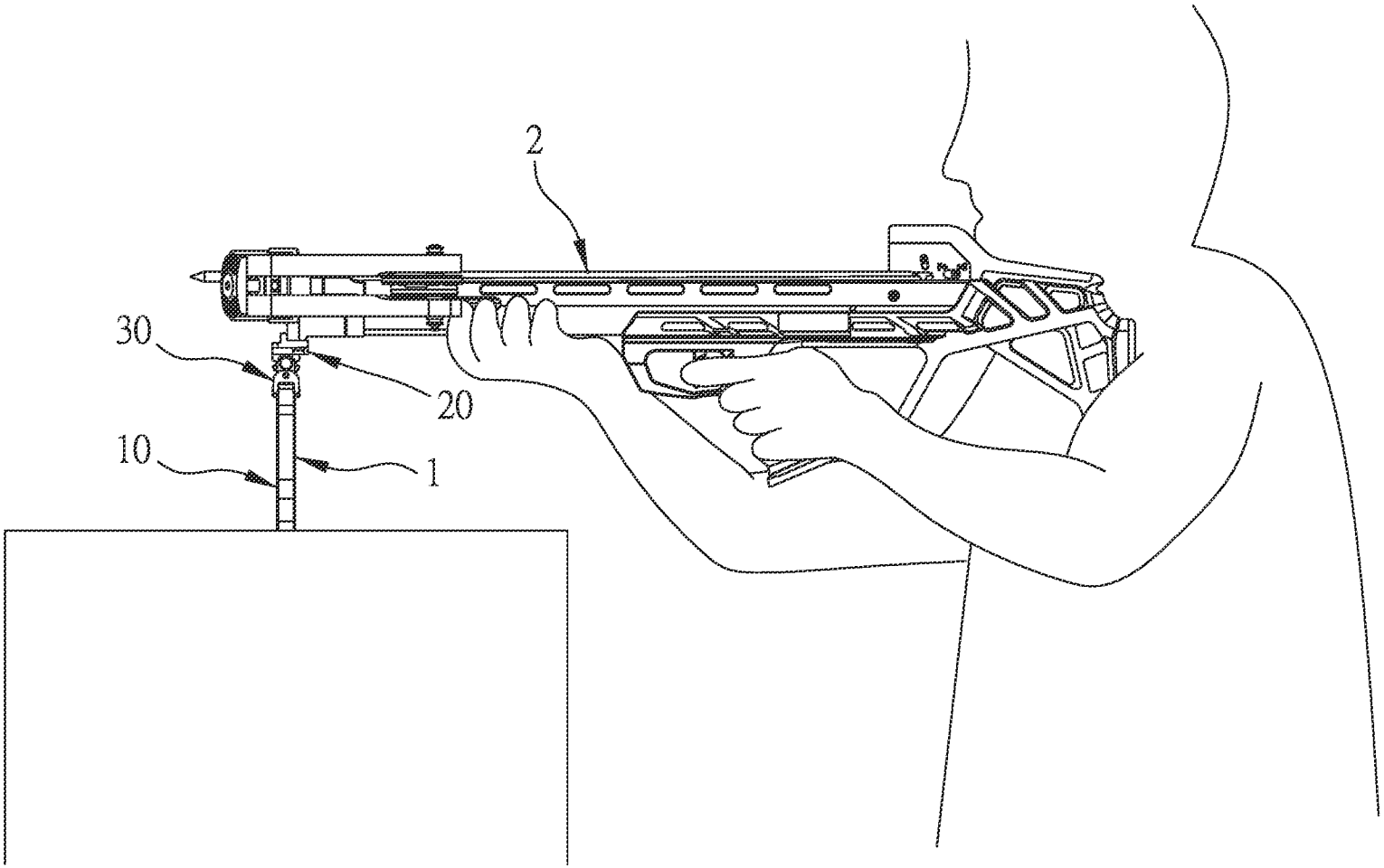
FIG. 14 is still another side plane view showing the operation of the collapsible pedal structure of the crossbow according to the preferred embodiment of the present invention.

As illustrated in FIGS. 12 and 13, the fastener 30 is controlled by the two operation portions 33 of the fastener 30 to slide toward the stepping portion 11 so that the defining rod 35 disengages from the one notch 222 of the second coupling seat 22 of the connection member 20, and the pedal 10 is rotated to the third direction A3 (downward at an right angle), then the fastener 30 is released so that the defining rod 35 is urged by the spring 123 to move toward the groove 121 and to engage into the one notch 222 of the second coupling seat 22 of the connection member 20 so that the pedal 10 is positioned downward at the right angle so as to be used as a support bipod when shooting, as shown in FIG. 14.

Figure 15:
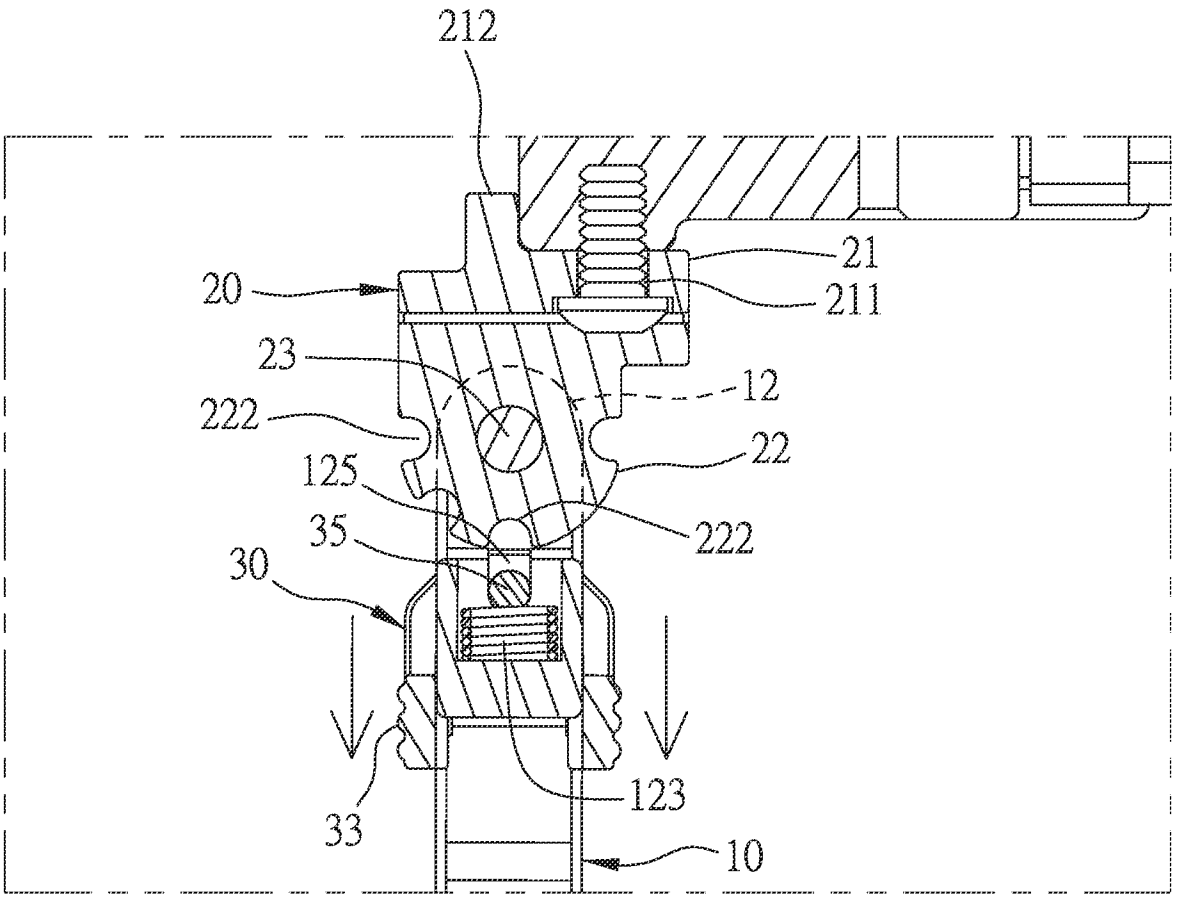
FIG. 15 is also another cross sectional view showing the operation of the collapsible pedal structure of the crossbow according to the preferred embodiment of the present invention.
Figure 16:
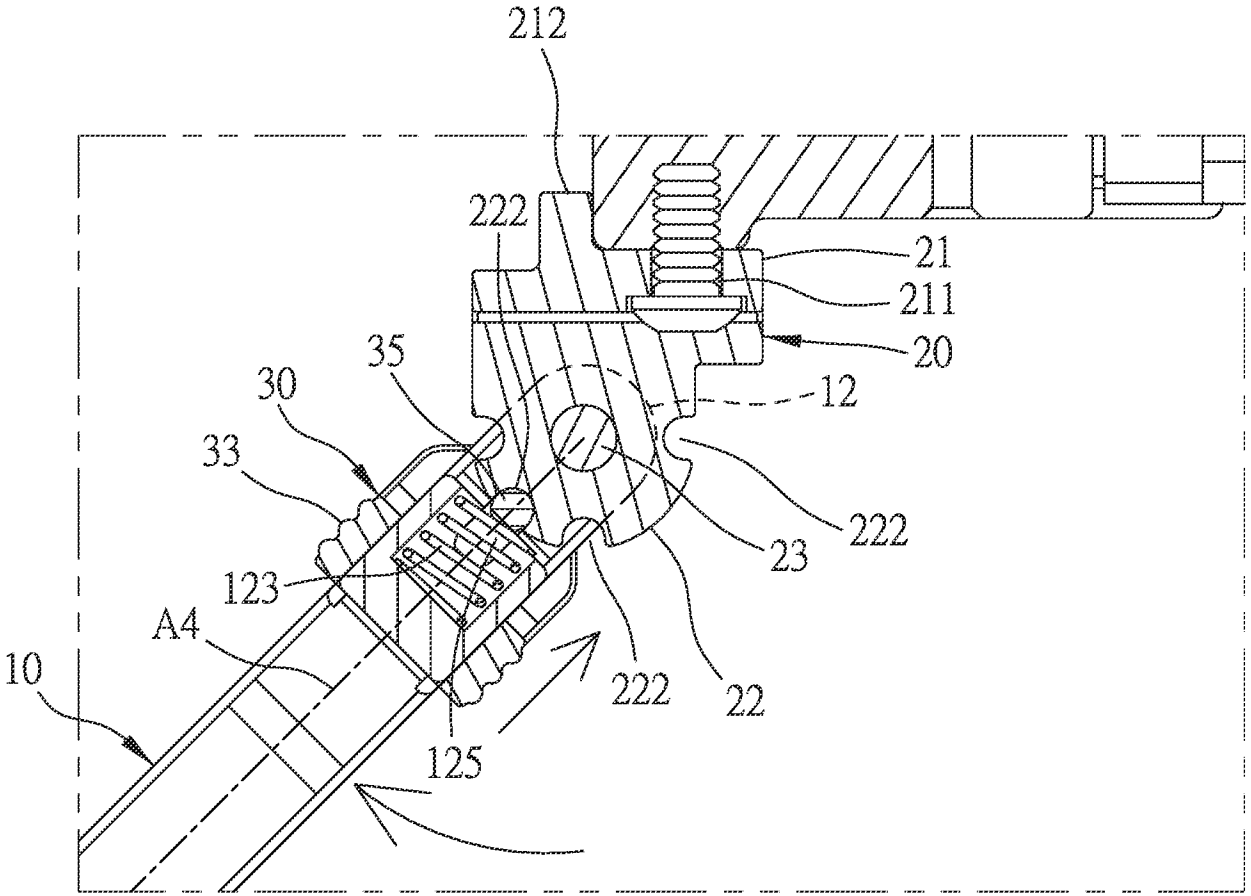
FIG. 16 is still another cross sectional view showing the operation of the collapsible pedal structure of the crossbow according to the preferred embodiment of the present invention.
Figure 17:
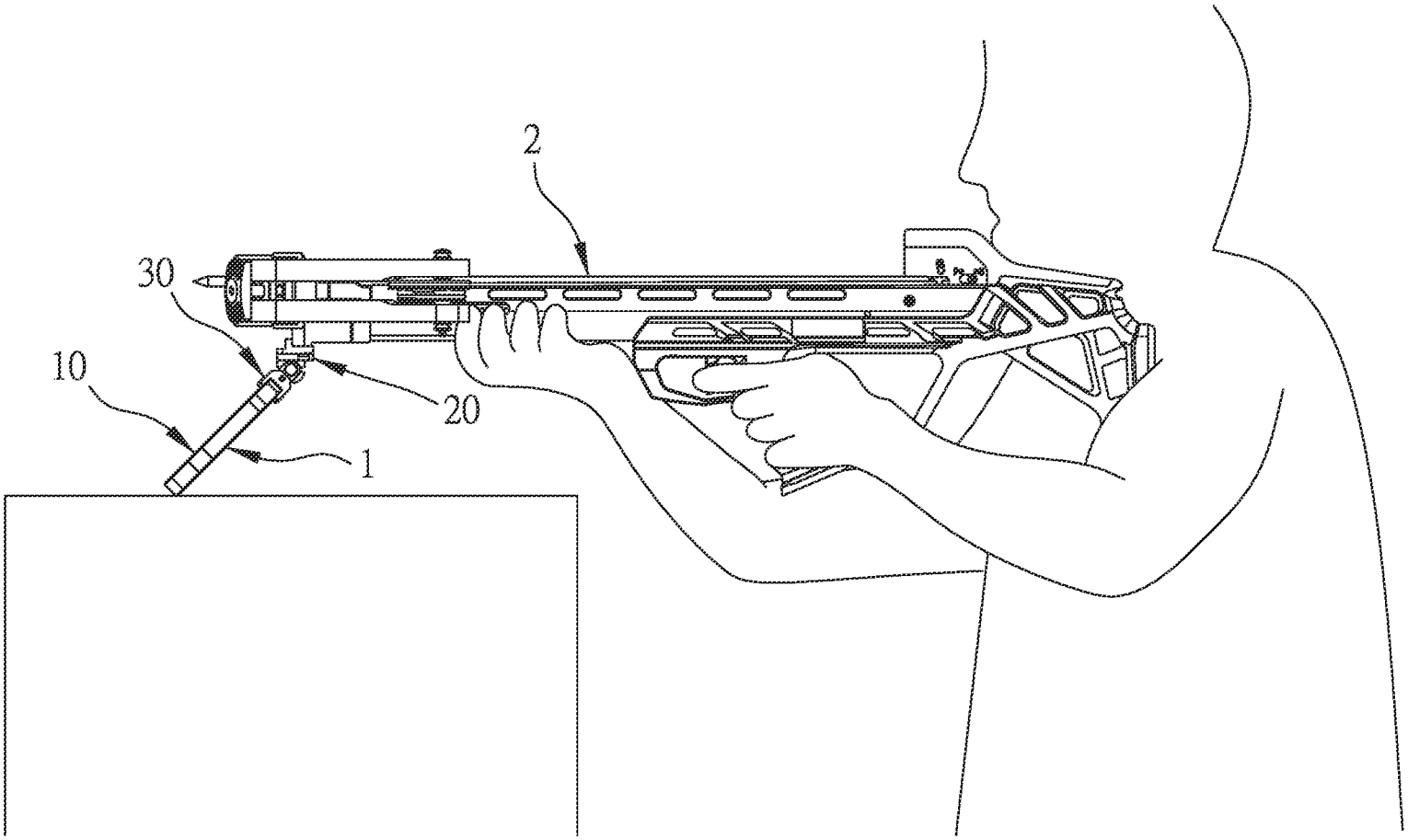
FIG. 17 is another side plane view showing the operation of the collapsible pedal structure of the crossbow according to the preferred embodiment of the present invention.

With reference to FIGS. 15 and 16, the two operation portions 33 of the fastener 30 control the fastener 30 to slide toward the stepping portion 11 so that the defining rod 35 disengages from the one notch 222 of the second coupling seat 22 of the connection member 20, and the pedal 10 is rotated toward the fourth direction A4 (downward and forward). Thereafter, the fastener 30 is released so that the defining rod 35 is urged by the spring 123 to move toward the groove 121 and to engage into the one notch 222 of the second coupling seat 22 of the connection member 20, hence the pedal 10 is positioned downward and forward, as illustrated in FIG. 17, and the pedal 10 is used as the support bipod when shooting.

Accordingly, the collapsible pedal structure of the crossbow has advantages as follows:

the pedal 10 is rotated adjustably with respect to the connection member 20, for example, the pedal 10 is rotated forward so that the user's foot inserts and steps the crossbow 2, and the bowstring 2A is tighten. Alternatively, the pedal 10 is rotated downward and forward or downward at the right angle so as to be as the support bipod of the crossbow 2 when shooting. Preferably, the pedal 10 is rotated backward to be portable and storable easily.

While various embodiments in accordance with the present invention have been shown and described, it is clear to those skilled in the art that further embodiments may be made without departing from the scope of the present invention.

What is claimed is:

1. A collapsible pedal structure of a crossbow mounted on the crossbow, the crossbow including a bowstring and a string pulling direction, and the collapsible pedal structure comprising:

a pedal including a stepping portion formed on a first side of the pedal, a first coupling seat formed on a second side of the pedal;

a connection member including a second coupling seat configured to rotatably connect the connection member with the first coupling seat of the pedal so that the pedal rotates in a first direction and a second direction, and the first direction being opposite to the string pulling direction and corresponding to one of multiple notches, and the second direction being the same as the string pulling direction and corresponding to another of the multiple notches; and a fastener defined between the pedal and the connection member, the fastener including an aperture configured to receive a defining rod, a releasing means and a fastening means, the fastening means being configured to fix the pedal in the first direction and the second direction so that the pedal does not rotate, in the meantime, the defining rod being engaged in the one notch, the releasing means being configured to release the fastening means, in the meantime, the defining rod disengages form the one notch so that the pedal rotates along the connection member.

2. The collapsible pedal structure as claimed in claim 1, wherein the pedal rotates in a third direction between the first direction and the second direction, and the third direction is perpendicular to the crossbow, the pedal is fixed by way of the third direction and does not rotate, and the pedal rotates along the connection member by using the releasing means, wherein the second coupling seat further includes one of the multiple notches defined on an outer wall thereof and corresponding to the third direction.

3. The collapsible pedal structure as claimed in claim 2, wherein the releasing means and the fastening means including a sliding orifice defined on the fastener so as to fit with the first coupling seat, an aperture passing through the sliding orifice, an elongated hole defined on the first coupling seat and configured to receive the defining rod so as to limit the fastener to slide in a limited range.

4. The collapsible pedal structure as claimed in claim 2, wherein the first coupling seat has a groove, a receiving orifice defined on a bottom of the groove, a spring accommodated in the receiving orifice so that the fastener is urged by the spring to move close to the second coupling seat.

5. The collapsible pedal structure as claimed in claim 2, wherein the connection member includes a fixing plate and the second coupling seat extending from the fixing plate downward, and the fixing plate has multiple locking orifices and a positioning shoulder, and the fixing plate are screwed on a bottom of a front end of the crossbow by using the multiple locking orifices.

6. The collapsible pedal structure as claimed in claim 1, wherein the pedal rotates in a fourth direction between the first direction and the second direction, and the fourth direction leans to the first direction, the pedal is fixed in the fourth direction by way of the fastening means and does not rotate, and the releasing means is configured to rotate the pedal along the connection member, the second coupling seat includes one of the multiple notches defined on an outer wall thereof and corresponding to the fourth direction.

7. The collapsible pedal structure as claimed in claim 6, wherein the releasing means and the fastening means including a sliding orifice defined on the fastener so as to fit with the first coupling seat, an aperture passing through the sliding orifice, an elongated hole defined on the first coupling seat and configured to receive the defining rod so as to limit the fastener to slide in a limited range.

8. The collapsible pedal structure as claimed in claim 6, wherein the first coupling seat has a groove, a receiving orifice defined on a bottom of the groove, a spring accommodated in the receiving orifice so that the fastener is urged by the spring to move close to the second coupling seat.

9. The collapsible pedal structure as claimed in claim 6, wherein the connection member includes a fixing plate and the second coupling seat extending from the fixing plate downward, and the fixing plate has multiple locking orifices and a positioning shoulder, and the fixing plate are screwed on a bottom of a front end of the crossbow by using the multiple locking orifices.

10. The collapsible pedal structure as claimed in claim 1, wherein the connection member is rotatably connected with the first coupling seat of the pedal by using the second coupling seat, the first coupling seat has a first connection orifice, and the second coupling seat has a second connection orifice, wherein a connection shaft is inserted through the first connection orifice and the second connection orifice so that the first coupling seat is rotatably connected with the second coupling seat.

11. The collapsible pedal structure as claimed in claim 1, wherein the releasing means and the fastening means including a sliding orifice defined on the fastener so as to fit with the first coupling seat, an aperture passing through the sliding orifice, an elongated hole defined on the first coupling seat and configured to receive the defining rod so as to limit the fastener to slide in a limited range.

12. The collapsible pedal structure as claimed in claim 1, wherein the first coupling seat has a groove, a receiving orifice defined on a bottom of the groove, a spring accommodated in the receiving orifice so that the fastener is urged by the spring to move close to the second coupling seat.

13. The collapsible pedal structure as claimed in claim 1, wherein the connection member includes a fixing plate and the second coupling seat extending from the fixing plate downward, and the fixing plate has multiple locking orifices and a positioning shoulder, and the fixing plate are screwed on a bottom of a front end of the crossbow by using the multiple locking orifices.

14. The collapsible pedal structure as claimed in claim 1, wherein the fastener includes a trench defined on a first side thereof.

15. The collapsible pedal structure as claimed in claim 1, wherein the fastener includes two operation portions formed on a top and a bottom of the fastener, and the fastener includes multiple anti-slip ribs arranged on the two operation portions.

* * * * *